United States Patent [19]

Cortese

[11] 4,003,455

[45] Jan. 18, 1977

[54] BAG CONVERTIBLE INTO A PORTABLE SEAT

[76] Inventor: Gaetano Cortese, Via Ada Negri 9, 20032 Cormono (Milan), Italy

[22] Filed: June 4, 1975

[21] Appl. No.: 584,019

[30] Foreign Application Priority Data

June 18, 1974 Italy ..... 21416/74[U]

[52] U.S. Cl. ..... 190/8; 108/14; 150/1.7

[51] Int. Cl.[2] ..... A45C 9/00

[58] Field of Search ..... 150/1.7; 190/2, 8, 42; 248/164, 432; 108/14, 118, 119; 297/17, 118

[56] References Cited

UNITED STATES PATENTS

| | | | |
|---|---|---|---|
| 659,508 | 10/1900 | Collins | 108/118 |
| 1,549,647 | 8/1925 | Worthington | 190/8 |
| 2,558,995 | 7/1951 | Tullis | 190/8 |
| 2,843,185 | 7/1958 | Clem | 190/8 X |

*Primary Examiner*—Donald F. Norton
*Attorney, Agent, or Firm*—Michael J. Striker

[57] ABSTRACT

A bag convertible into a seat comprising two quadrangular metal frames articulatedly connected to each other midways at opposite side portions of each frame so that the frames may be moved between a closed position in which top and bottom portions of the frames are closely adjacent each other and a spread-apart position, tear resistant flexible material encompassing the frames and forming a bag having an upper open end and including a flap extending over the open end and downwardly over the front wall of the bag, when said frames are in the closed position. At least one, and preferably two, hooks are connected to the inner surface of the flap adjacent the free edge thereof adapted to engage with a top portion of one frame, when the frames are in the spread-apart position, to thereby hold the flap in taught condition over the wide-opened end of the bag for forming a seat.

6 Claims, 4 Drawing Figures

BAG CONVERTIBLE INTO A PORTABLE SEAT

This invention relates to a bag convertible into a portable seat, and more particularly this invention relates to a bag adapted to contain goods which be quickly and easily converted into a seat.

It is well known that the housekeepers, when they go out for shopping, in particular when they go to the supermarkets, are often compelled to queue up before effecting all the necessary shoppings and then going to pay at the desk: this is particularly trouble-some, since there being no seats available, they have to necessarily stand for quite a long time.

It is the specific object of this invention to provide a bag, normally utilizable for containing goods, which in case of need, may be quickly and simply converted into a seat, even if it already contains goods.

It is another object of this invention to provide a bag of such dimensions as to be easily taken by hand and converted into a seat whenever desired.

These and further objects of this invention are attained by the bag of this invention, including two quadrangular frames, preferably made from metal rods, being crossed with each other and articulated at the middle of the two of their opposite sides to form a double X.

The thus obtained folding structure is encompassed by suitable flexible material, such for example as fabric, sheet plastic material, leather, imitation leather, or others so as to form a parallelepipedon-shaped bag. The bag-like structure obtained has an open upper end and is provided with a flap adapted to extend over the open end of the bag and downwardly along the front wall of the bag. The flap is provided in the region of its free edge with a suitable fastener to connect the flap to the front wall of the bag. On the inner face of the flap there are fitted two strips having each at the free end a metal hook.

The hooks when both metal frames are spread out apart to the maximum extent, hook up on the horizontal rod of the frame adjacent to the free edge, of the flap to maintain the flap in stretched condition extending horizontal by over the open end of the bag and forming a seat.

A structure is thus built which in each and all respects conforms to that of a portable folding seat. To the two parallel, side and smaller faces of the bag there is applied a shoulder-belt also serving as handle as being reducible in length according to requirements through a well known type buckle. At the bottom of the bag there are provided four support feet.

These and further more specific characteristic features of the bag convertible into a seat according to this invention will become more apparent from the following detailed description taken in conjunction with the various figures on the accompanying drawing, in which.

Referring now particularly to the figures of the accompanying drawing, the bag of this invention includes two quadrangular frames 10 and 11 being closely similar to each other, preferably made from rod, which cross each other and are articulated at the central point of the two opposite vertical sides so as to form a double X.

Figure 4:
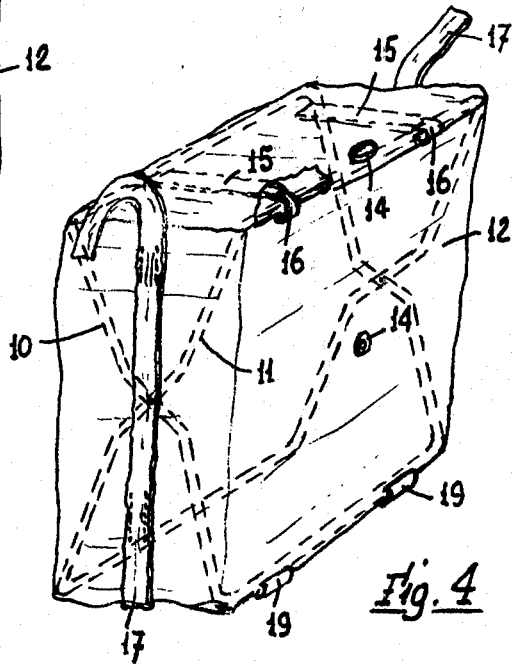
FIG. 4 shows a perspective side view of the bag shown in FIG. 3 when open and serving as a seat.

The structure obtained from said two quadrangular frames 10 and 11 is encompassed by suitable resisting flexible material 12, such, for example, as leather, fabric, plastic material, imitation leather, plastics coated cloth etc., so as to make up a parallelepipedon-shaped bag (FIG. 4). The flexible material 12 is placed so as to ensure the opening of the frame when the bag is filled.

Figure 3:
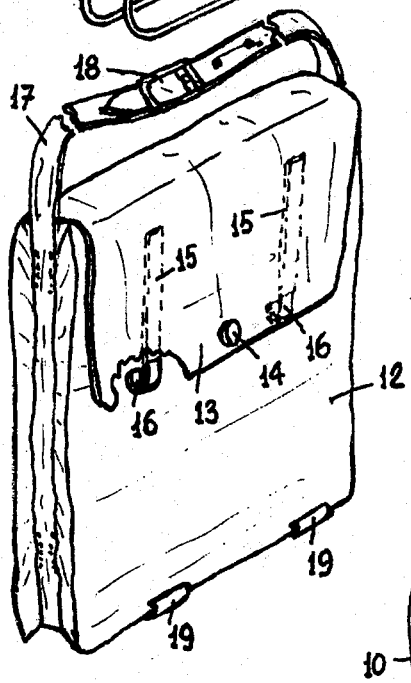
FIG. 3 represents in a perspective side view the closed and flattened bag, that is, when empty.

The bag is open at its upper end and has a flap 13, extending over the open end of the bag, and when the latter is folded as shown in FIG. 3, downwardly over the front side of the bag to be connected thereto with a suitable fastener 14.

Parallel to side edges of the flap 13 and perpendicular to the frame arms there are fitted on the inner face of the foap at least two similar parallel strips 15 at the free end of each of which a metal hook 16 is fastened, which, when the two frames are in a maximum spread out position hooks up to the upper horizontal arm of the frame 11, thereby preventing a further spreading apart of the two frames. The said strips 15 provide further a suitable support to the flap 13, which, by extending horizontally, when both frames are spread apart, serves as a support surface for the seat. The bag is provided with a strip 17, fastened to the two parallel, side and smaller faces of the bag itself, which via the well known type buckle 18 may be adjusted in length.

In this manner, the said strip 17 may be used both as a handle and shoulder-belt, depending on requirements set. To the larger sides of the bag, at its bottom, there are applied four similar support feet 19, consisting of relatively yielding material, such as rubber, plastic material or the like.

Figure 1:
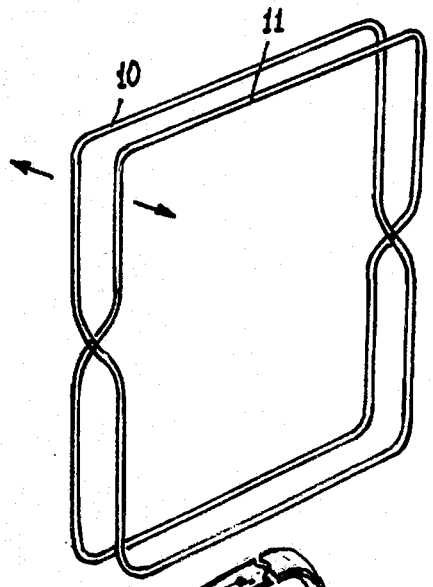
FIG. 1 represents in a schematic perspective view of the two metal frames crossed with each other and articulated to a flat position, when used in an empty bag.
Figure 2:
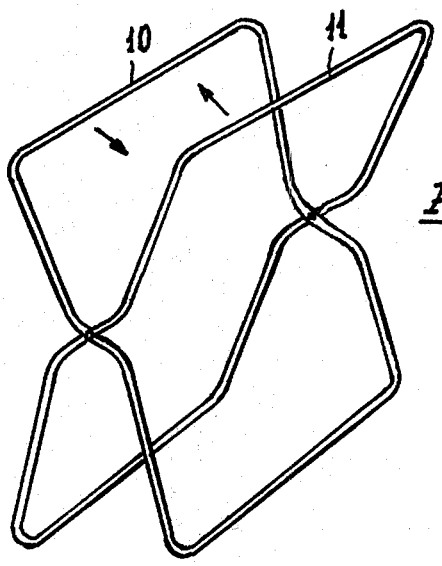
FIG. 2 shows in a perspective schematic view the two frames shown in FIG. 1 in a position of maximum spread out position, when serving as a seat.

When not used as seat and empty, the bag may be reduced to the minimum space, as it flattens like a bellows (FIGS. 1 and 3); while it serves as a seat even if containing wares or items, when the two frames 10 and 11 are spread apart.

From the foregoing specification it is possible to easily see the functional character, practical application and relatively low cost, characterizing the bag convertible into seat of this invention.

Needless to say, several changes and modifications as to shape, dimensions and costructions may be introduced in the invention without departing from the very spirit and protection scope of this invention.

I claim:

1. A bag convertible into a seat comprising two similar quadrangular frames having each a first pair of parallel normally horizontally extending frame portions and a second pair of parallel frame portions normal to said first frame portions and integrally connecting said first pair at opposite ends, the second pair of frame portions of one frame crossing the second pair of the other frame and are pivotally connected to the latter midway between opposite ends thereof, said frames being movable between a closed position in which said first frame portions of one frame are closely adjacent to said first frame portions of the other frame, and a spread-apart position; tear resistant, flexible material encompassing said frames to form a bag having an open end and including a flap extending over the open end and downwardly over a front portion of the bag, when said frames are in said closed position, said flap having a free edge located closely adjacent one of said first frame portions when said frames are in said spread-apart position; and at least one hook connected to the inner face of said flap adjacent said free edge and engageable with said one first frame portion in the spread-apart position of the frames so that said flap is held in taught condition over the wide-opened end of the bag to form a seating surface.

2. A bag convertible into a seat as defined in claim 1, wherein two hooks are connected transversely spaced from each other to the inner surface of said flap adjacent the free edge thereof.

3. A bag convertible into a seat as defined in claim 2, and including two parallel reinforcing strips connected to the inner surface of said flap, each of said strips having a free end to which said hooks are respectively connected.

4. A bag convertible into a seat as defined in claim 1, wherein said bag has a pair of side walls, and including a pair of strip portions fastened to said side walls and extending over the open end of said bag, each of said strip portions having a free end, and means for adjustably connecting said free ends to each other.

5. A bag convertible into a seat as defined in claim 1, wherein said bag has a bottom wall and including a plurality of supports of resilient material connected to said bottom wall.

6. Bag convertible into a seat as defined in claim 1, in which the quadrangular frames consist of metal rod.

* * * * *